US005424816A

United States Patent [19]

Fox et al.

[11] Patent Number: 5,424,816

[45] Date of Patent: Jun. 13, 1995

[54] TONER CARTRIDGE

[75] Inventors: Wayne D. Fox, Rochester; Paul M. Wegman, Pittsford; Roger C. Hopkins, Rochester, all of N.Y.

[73] Assignee: Xerox Corporation, Stamford, Conn.

[21] Appl. No.: 266,288

[22] Filed: Jun. 27, 1994

[51] Int. Cl.[6] ..... G03G 15/08

[52] U.S. Cl. ..... 355/260; 222/DIG. 1

[58] Field of Search ..... 355/260, 253, 245; 222/DIG. 1

[56] References Cited

U.S. PATENT DOCUMENTS

| | | | |
|---|---|---|---|
| 3,979,022 | 9/1976 | Whited | 222/23 |
| 4,478,512 | 10/1984 | Zoltner | 355/3 |
| 4,739,907 | 4/1988 | Gallant | 222/DIG. 1 |
| 4,827,307 | 5/1989 | Zoltner | 355/3 |
| 4,924,920 | 5/1990 | Bhagwat | 355/260 |
| 5,030,997 | 7/1991 | Michlin | 355/260 |
| 5,078,303 | 1/1992 | Kikuchi et al. | 222/167 |
| 5,118,013 | 6/1992 | Mutou et al. | 222/DIG. 1 |
| 5,235,389 | 8/1993 | Kikuchi et al. | 355/260 |
| 5,235,389 | 8/1993 | Kikuchi et al. | 355/260 |
| 5,257,077 | 10/1993 | Peters et al. | 355/260 |
| 5,261,568 | 11/1993 | Corby et al. | 222/167 |
| 5,264,901 | 11/1993 | Rossiter | 222/DIG. 1 |
| 5,280,324 | 1/1994 | Ono et al. | 355/260 |
| 5,331,382 | 7/1994 | Miura et al. | 355/260 |

FOREIGN PATENT DOCUMENTS

| | | | |
|---|---|---|---|
| 0360198 | 3/1990 | European Pat. Off. | 355/260 |
| 61-51177 | 3/1986 | Japan | 355/260 |

*Primary Examiner*—R. L. Moses

*Attorney, Agent, or Firm*—Zosan S. Soong

[57] ABSTRACT

There is disclosed an apparatus for storing a supply of marking particles therein, including: (a) a container defining a chamber for storing the marking particles therein and a discharge opening in communication with the chamber for the discharge of the marking particles; (b) a flange member coupled to the container, wherein the flange member includes a flange wall that defines a flange opening in communication with the chamber for loading of the marking particles into the chamber; (c) an agitator mounting member fixedly positioned adjacent the flange opening, wherein the mounting member includes an agitator end coupling portion which is spaced from the flange wall defining the flange opening; and (d) an agitator disposed within the chamber, wherein the agitator has an end coupled to the agitator end coupling portion, whereby the agitator end is spaced from the flange wall defining the flange opening.

16 Claims, 4 Drawing Sheets

TONER CARTRIDGE

This invention relates generally to a toner cartridge for use in an electrostatographic printing apparatus which includes printing and/or copying devices.

In the process of electrostatographic printing, a charge-retentive surface, such as a photoreceptor, is charged to a substantially uniform potential so as to sensitize the surface thereof. The charged portion of the photoconductive surface is exposed to a light image of an original document being reproduced, or a scanned laser image created by the action of digital image data acting on a laser source. The scanning or exposing step records an electrostatic latent image on the photoreceptor corresponding to the informational areas in the document to be printed or copied. After the latent image is recorded on the photoreceptor, the latent image is developed by causing toner particles to adhere electrostatically to the charged areas forming the image. This developed image on the photoreceptor is subsequently transferred to a sheet on which the desired image is to be printed. Finally, the toner on the sheet is heated to permanently fuse it to the sheet in image configuration.

One familiar type of development of an electrostatic image is called "two-component development." Two-component developer largely comprises toner particles interspersed with carrier particles. The carrier particles are magnetically attractable, and the toner particles are caused to adhere triboelectrically to the carrier particles. This two-component developer can be conveyed, by means such as a "magnetic roll," to the electrostatic latent image, where toner particles become detached from the carrier particles and adhere as desired to the electrostatic latent image.

Toner cartridges are used to provide a supply of marking particles such as toner particles or a mixture of toner and carrier particles to electrostatographic printing apparatus. Toner cartridges typically comprise a container, an agitator to stir the supply of marking particles, and end flange members coupled to the ends of the container. FIGS. 1 and 2 show a prior art flange member 2, disposed at one end of the toner cartridge (not shown), that defines a flange opening 4 (also referred to herein as a "toner fill hole") which facilitates the loading of marking particles into the toner cartridge. The prior art flange member 2 also includes an integral compartment 6 for waste toner. The prior art flange member 2 includes an agitator mounting 8 which extends from the flange wall 10 defining the toner fill hole 4. An end of the agitator (not shown) may be inserted into the opening 9 defined by the agitator mounting 8. A problem with the prior art flange member 2 is that the size of the toner fill hole 4 is restricted since the agitator mounting 8 is integral with the flange wall 10 defining the toner fill hole. There is thus a need for a new toner cartridge design wherein the position of the agitator mounting does not restrict the size of the toner fill hole.

Toner cartridges and electrostatographic printing apparatus are illustrated for example in Kikuchi et al., U.S. Pat. No. 5,235,389; Zoltner, U.S. Pat. No. 4,827,307; Zoltner, U.S. Pat. No. 4,478,512; and Whited, U.S. Pat. No. 3,979,022, the disclosures of which are totally incorporated by reference.

Marotta et al., U.S. appln. Ser. No. 08/157,514 (Attorney Docket No. D/93451), filed Nov. 26, 1993, titled "Shutter Seal Assembly," discloses a storage sump for the storage of toner cleaned from a photoreceptor, which is united with a toner dispensing container to form a removable process unit which performs the dual functions of the supply of new toner and the storage of waste toner.

SUMMARY OF THE INVENTION

It is an object in embodiments of the invention to provide a toner cartridge wherein the position of the agitator mounting does not restrict the size of the toner fill hole.

These objects and others are accomplished in embodiments by providing an apparatus for storing a supply of marking particles therein, including:

(a) a container defining a chamber for storing the marking particles therein and a discharge opening in communication with the chamber for the discharge of the marking particles;

(b) a flange member coupled to the container, wherein the flange member includes a flange wall that defines a flange opening in communication with the chamber for loading of the marking particles into the chamber;

(c) an agitator mounting member fixedly positioned adjacent the flange opening, wherein the mounting member includes an agitator end coupling portion which is spaced from the flange wall defining the flange opening; and (d) an agitator disposed within the chamber, wherein the agitator has an end coupled to the agitator end coupling portion, whereby the agitator end is spaced from the flange wall defining the flange opening.

In embodiments of the instant invention, there is also provided an electrostatographic printing apparatus comprising:

(a) a charge retentive surface; and (b) a storage apparatus for storing a supply of marking particles therein, including:

(i) a container defining a chamber for storing the marking particles therein and a discharge opening in communication with the chamber for the discharge of the marking particles;

(ii) a flange member coupled to the container, wherein the flange member includes a flange wall that defines a flange opening in communication with the chamber for loading of the marking particles into the chamber;

(iii) an agitator mounting member fixedly positioned adjacent the flange opening, wherein the mounting member includes an agitator end coupling portion which is spaced from the flange wall defining the flange opening; and (iv) an agitator disposed within the chamber, wherein the agitator has an end coupled to the agitator end coupling portion, whereby the agitator end is spaced from the flange wall defining the flange opening.

BRIEF DESCRIPTION OF THE DRAWINGS

Other aspects of the present invention will become apparent as the following description proceeds and upon reference to the Figures which represent preferred embodiments and are substantially to scale.

Unless otherwise noted, the same reference numeral in the Figures refers to the same or similar feature.

DETAILED DESCRIPTION

Figure 3:
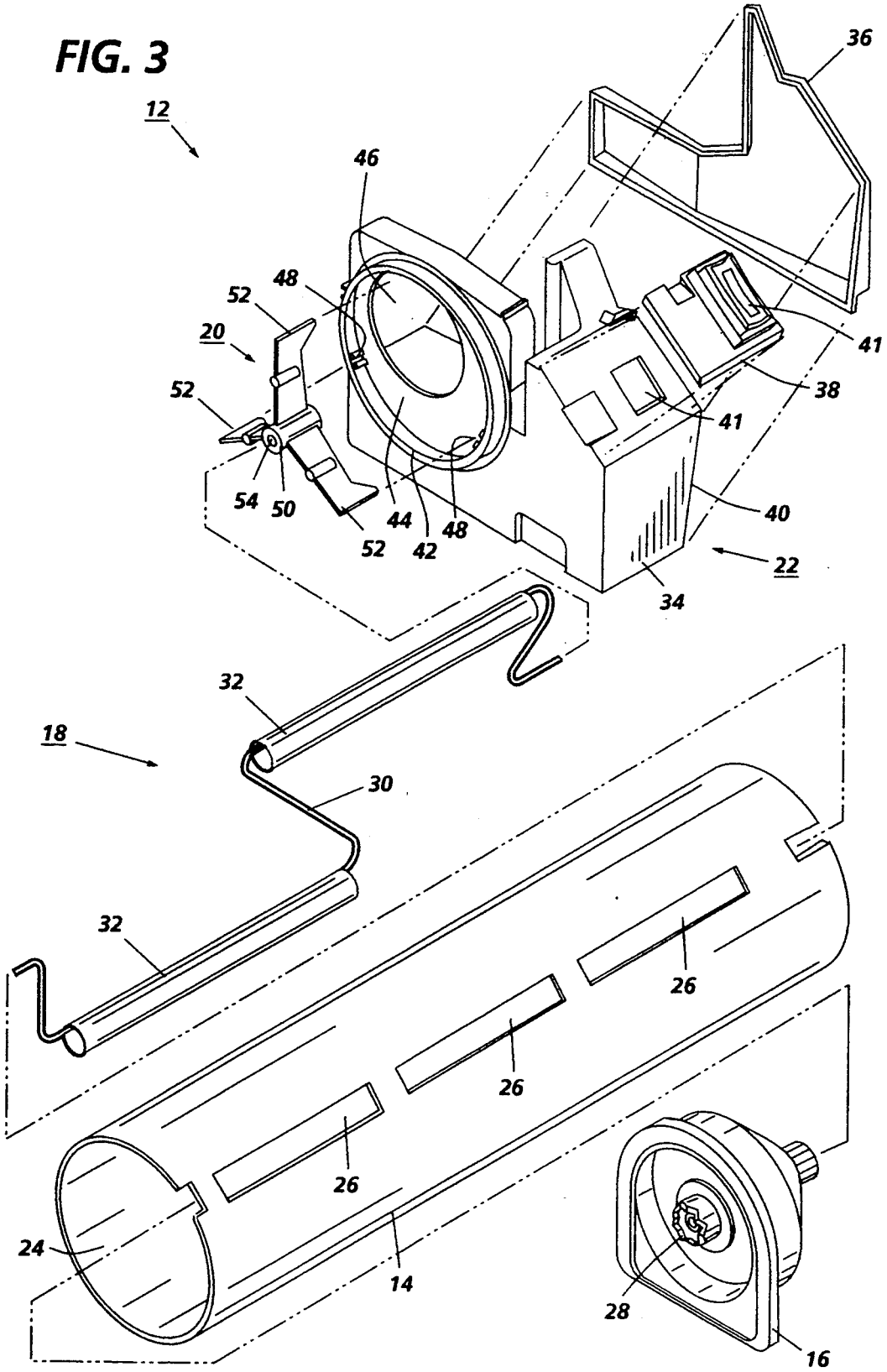
FIG. 3 is a schematic, perspective, exploded view of a toner cartridge of the instant invention.

FIG. 3 discloses a toner cartridge 12 which is comprised of a container 14, a first flange member 16, an agitator 18, an agitator mounting member 20, and a second flange member 22. The container 14 defines a chamber 24 for storing the marking particles therein and one or more discharge openings 26 in communication with the chamber for the discharge of the marking particles. A removable sealing strip (not shown) covers the discharge openings 26 until the strip is removed during installation of the toner cartridge in an electrostatographic printer. The chamber 24 may extend throughout the length of the preferably tube-shaped container 14, resulting in for example a hollow container having open ends. The first flange member 16 is coupled to one end of the container 14. A rotatable gear 28 is coupled to the first flange member 16 and an end of the agitator shaft 30 is coupled to the gear 28, whereby rotation of the gear 28 rotates the agitator 18 within the chamber 24. The agitator 18 comprises for example an agitator shaft 30 and a number of agitator tubes 32 such as two or more.

The second flange member 22 may be comprised of for example a housing 34, a back plate 36, and a top plate 38. The components of the second flange member 22 may be integral with one another and may be attached together by for example bonding with an adhesive or by welding. The housing 34 may define a compartment 40, i.e., a waste sump, for receiving waste marking particles through waste sump opening 41. The housing 34 may include an integral collar portion 42 which extends from the flange wall 44 defining a flange opening 46. The flange opening 46 is in communication with the chamber 24 for loading of the marking particles into the chamber 24. An end cap (not shown), which may be plastic or metal, plugs the flange opening 46 subsequent to the loading of the marking particles into the chamber. The collar portion 42 is preferably circular in shape and includes an optional engaging means 48, in the form of for example grooves or tracks, for engaging the agitator mounting member 20. There may be for example two, three, or more sets of grooves or tracks disposed around the inner surface of the collar portion 42.

The agitator mounting member 20 is comprised of an agitator end coupling portion 50, which may be bullet-shaped, and a plurality of supporting legs 52 such as two, three, four, or more, that are integral with and extend from the agitator end coupling portion 50. The supporting legs 52 may be arranged in a tripod pattern. The agitator end coupling portion 50 at one end defines an opening 54 which is engaged with an end of the agitator, particularly the agitator shaft 30. The agitator mounting member 20 may be fixedly disposed in the collar portion 42 by for example engaging the ends of the supporting legs 52 with the engaging means 48, which may be in the form of grooves or tracks, thereby minimizing or eliminating the possibility of rotation of the agitator mounting member. To fixedly position the agitator mounting member inside the collar portion, the agitator mounting member also may be for instance solvent bonded using an adhesive or welded to the collar portion. In embodiments, the agitator mounting member 20 is integral with the second flange member 22. The supporting legs 52 of the agitator mounting member 20 may contact the wall 44 defining the flange opening 46. The agitator end coupling portion 50 may be disposed so that the opening 54, i.e., the front end, faces in the direction of the chamber. The back of the agitator end coupling portion 50 preferably does not contact the wall 44 defining the flange opening 46 and is spaced from the plane defined by the flange opening 46, at a distance ranging for example from about 5 mm to about 3 cm. In an alternate embodiment, the agitator mounting member 20 is disposed within the chamber 24 of the container, whereby the agitator mounting member may be coupled to the walls of the chamber.

Figure 1:
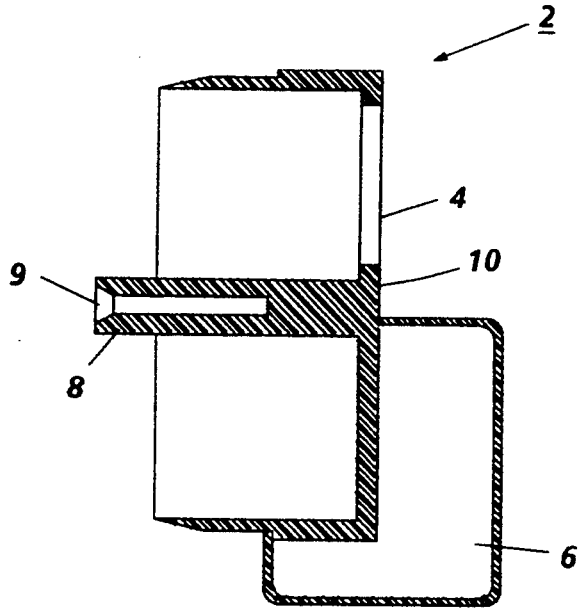
PRIOR ART FIG. 1
FIG. 1 is a representation of a prior art flange member in a schematic, side, cross-sectional view.
Figure 2:
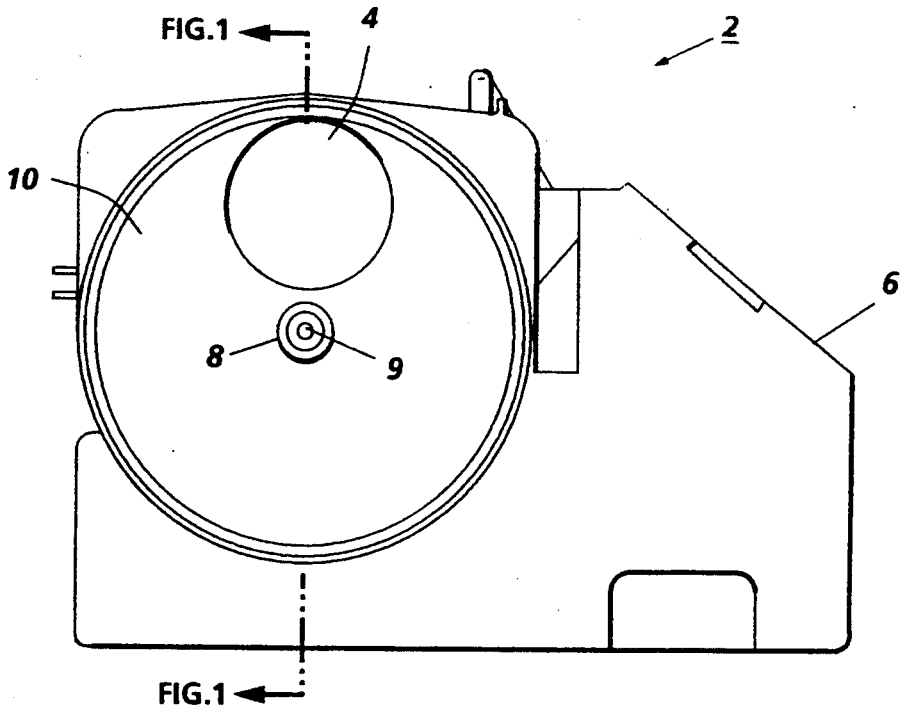
PRIOR ART FIG. 2
FIG. 2 is a representation of a prior art flange member in a schematic, front view.

The flange opening 46 has a width which may be at least about 50% the width of the chamber 24, up to the width of the chamber. Preferably, the flange opening has a width ranging in size from about 60% to about 90% the width of the chamber. In embodiments of the present invention, the flange opening may have almost the same width as the chamber, i.e., about 100% the width of the chamber, especially in the absence of an integral compartment for receiving waste toner particles. The instant invention allows the flange opening to increase in size as compared with the prior art flange member disclosed in FIGS, 1–2. For example, the prior art flange member 2 of FIGS. 1–2 may have a flange opening 4 diameter of 25.4 mm, whereas the flange opening 46 in a preferred embodiment of the instant invention may be 32 mm in diameter. By increasing the width of the flange opening, there may result fewer fill head problems in filling the toner cartridge and/or an increase in the rate of filling the toner cartridge, thereby boosting productivity.

The sealing strip is a flexible member which is removably secured, by for example an adhesive, to the container, thereby sealing the flange opening in the surface thereof to prevent the discharge of the marking particles. The sealing strip is preferably made of a plastic material coated with a layer of heat sensitive adhesive material.

The components of the toner cartridge may be fabricated from any suitable material and by any appropriate method. For instance, the container may be fabricated from a plastic material, derived from the blow mold process. This form of manufacture results in a single structural piece, with all parts made singularly from the same material. On the other hand, the body of the container may be made from paper in tube form. The first flange member, the second flange member, and the agitator mounting member may be fabricated of a metal or plastic.

Figure 4:
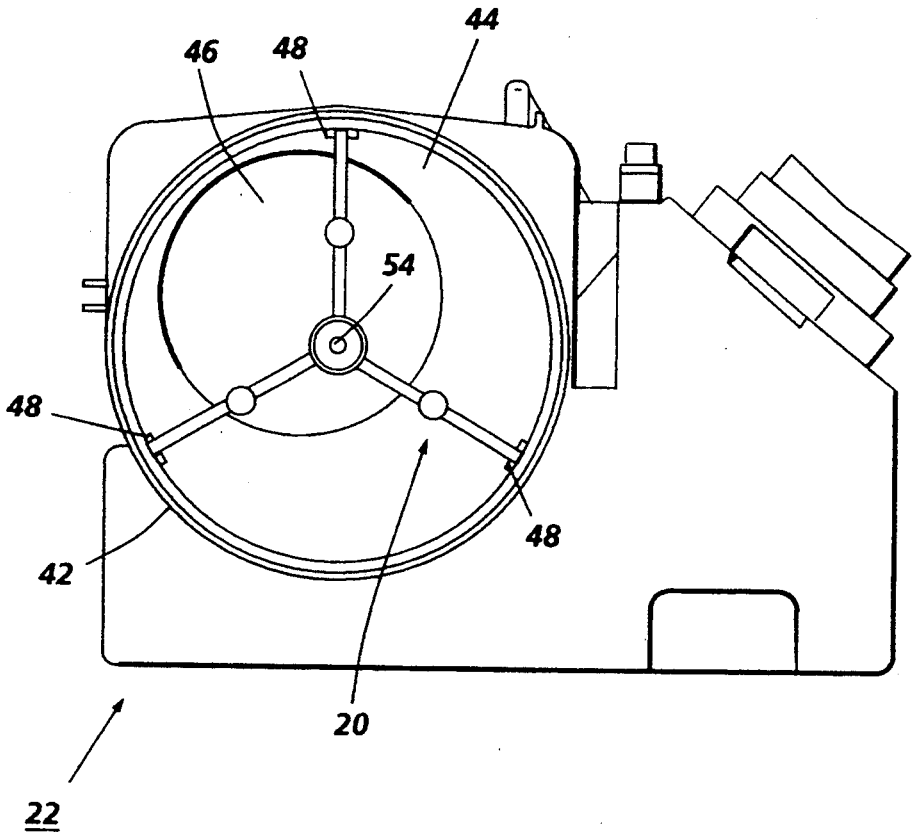
FIG. 4 is a schematic, front view of a flange member and an agitator mounting member employed in the toner cartridge of the instant invention.

FIG. 4 is a front view of the second flange member 22 and the agitator mounting member 20, which is disposed in the collar portion 42.

Figure 5:
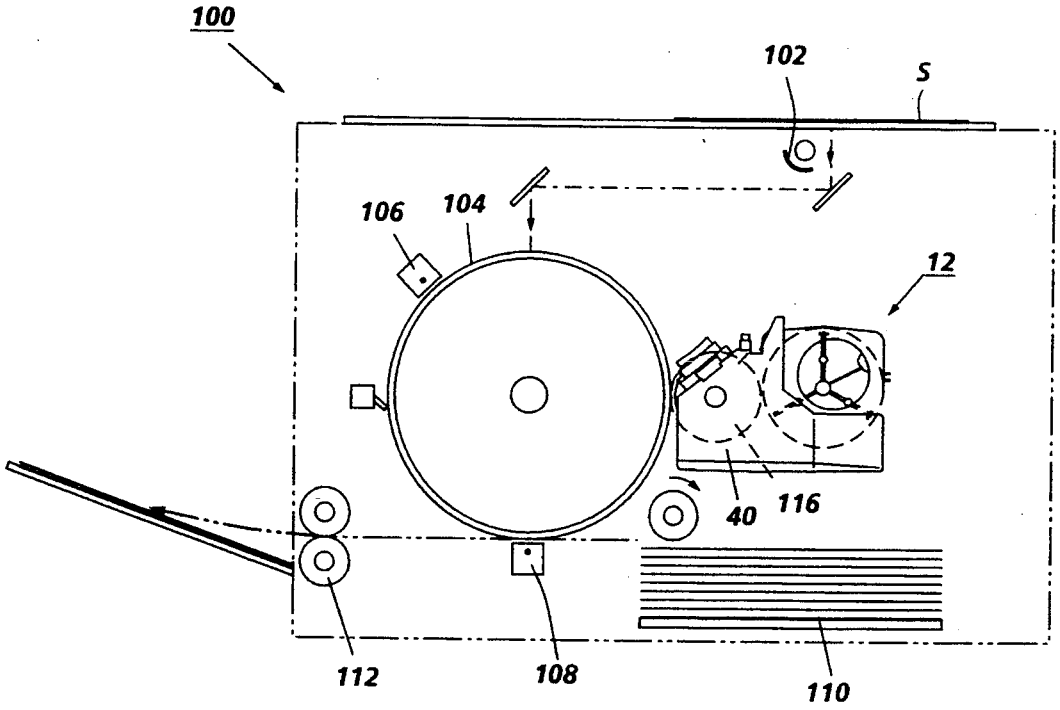
FIG. 5 is a schematic, side view showing the elements of an electrostatographic printer, in this case a copier, incorporating the toner cartridge of the instant invention.

FIG. 5 is a simplified side view showing the basic elements of an electrostatographic printer, in this case a copier, incorporating the toner cartridge 12 of the present invention. The copier, generally indicated as 100, includes an exposure means 102, which may include a lamp, mirror, and self-focusing lens arrangement for obtaining an exposure of an original on sheet S to be copied. The image on sheet S is then exposed onto the surface of a photoreceptor 104 which has been previously charged by means of a corotron 106. When the charged surface of photoreceptor 104 is exposed to the image on sheet S, various portions of the surface will be discharged in imagewise fashion as they are exposed to light from the image. Those areas of the photoreceptor 104 which were not discharged in the exposure step are then developed by development unit 116 (shown schematically), and in particular by the magnetic roll (not shown), so that toner is caused to adhere to the charged areas of photoreceptor 104, creating a "developed" image of the original. This developed image is then moved, by the rotation of photoreceptor 104, to a transfer station 108, where the toner on the photoreceptor is electrostatically transferred to a sheet of plain paper from stack 110. The sheet from stack 110 which receives the toner particles in imagewise fashion, is then sent through a fuser 112, which causes the toner particles to be melted onto the sheet to form a permanent image.

In FIG. 5 there can be seen, interacting with development unit 116, a toner cartridge 12 of the instant invention. Toner cartridge 12 is designed to supply toner to the input port (not shown) of development unit 116, while the compartment 40 is a waste sump which receives used marking particles from the output port (not shown) of the development unit 116.

Other modifications of the present invention may occur to those skilled in the art based upon a reading of the present disclosure and these modifications are intended to be included within the scope of the present invention.

We claim:

1. An apparatus for storing a supply of marking particles therein, including:

(a) a container defining a chamber for storing the marking particles therein and a discharge opening in communication with the chamber for the discharge of the marking particles;

(b) a flange member coupled to the container, wherein the flange member includes a flange wall that defines a flange opening in communication with the chamber for loading of the marking particles into the chamber;

(c) an agitator mounting member fixedly positioned adjacent the flange opening, wherein the mounting member includes an agitator end coupling portion which is spaced from the flange wall defining the flange opening; and (d) an agitator disposed within the chamber, wherein the agitator has an end coupled to the agitator end coupling portion, whereby the agitator end is spaced from the flange wall defining the flange opening.

2. The apparatus of claim 1, wherein the agitator mounting member is comprised of the agitator end coupling portion and a plurality of supporting legs that extend from the agitator end coupling portion.

3. The apparatus of claim 2, wherein there are three supporting legs which extend from the agitator end coupling portion in a tripod pattern.

4. The apparatus of claim 1, wherein the agitator end coupling portion defines an opening to receive the agitator end.

5. The apparatus of claim 1, wherein the flange member includes a hollow collar portion, and wherein the agitator mounting member is fixedly positioned within the collar portion.

6. The apparatus of claim 1, wherein the flange opening has a width which is at least about 50% the width of the chamber.

7. The apparatus of claim 1, wherein the flange opening has a width ranging in size from about 60% to about 90% the width of the chamber.

8. The apparatus of claim 1, wherein the agitator mounting member contacts the flange wall and the agitator end coupling portion is spaced from the flange wall defining the flange opening.

9. An electrostatographic printing apparatus comprising:

(a) a charge retentive surface; and (b) a storage apparatus for storing a supply of marking particles therein, including:

(i) a container defining a chamber for storing the marking particles therein and a discharge opening in communication with the chamber for the discharge of the marking particles;

(ii) a flange member coupled to the container, wherein the flange member includes a flange wall that defines a flange opening in communication with the chamber for loading of the marking particles into the chamber;

(iii) an agitator mounting member fixedly positioned adjacent the flange opening, wherein the mounting member includes an agitator end coupling portion which is spaced from the flange wall defining the flange opening; and (iv) an agitator disposed within the chamber, wherein the agitator has an end coupled to the agitator end coupling portion, whereby the agitator end is spaced from the flange wall defining the flange opening.

10. The apparatus of claim 9, wherein the agitator mounting member is comprised of the agitator end coupling portion and a plurality of supporting legs that extend from the agitator end coupling portion.

11. The apparatus of claim 10, wherein there are three supporting legs which extend from the agitator end coupling portion in a tripod pattern.

12. The apparatus of claim 9, wherein the agitator end coupling portion defines an opening to receive the agitator end.

13. The apparatus of claim 9, wherein the flange member includes a hollow collar portion, and wherein the agitator mounting member is fixedly positioned within the collar portion.

14. The apparatus of claim 9, wherein the flange opening has a width which is at least about 50% the width of the chamber.

15. The apparatus of claim 9, wherein the flange opening has a width ranging in size from about 60% to about 90% the width of the chamber.

16. The apparatus of claim 9, wherein the agitator mounting member contacts the flange wall and the agitator end coupling portion is spaced from the flange wall defining the flange opening.

* * * * *